US007295176B2

(12) United States Patent
Yang

(10) Patent No.: US 7,295,176 B2
(45) Date of Patent: Nov. 13, 2007

(54) LED DRIVER WITH CONSTANT CURRENT OFFSET UNIT

(75) Inventor: Joon-hyun Yang, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 11/342,572

(22) Filed: Jan. 31, 2006

(65) Prior Publication Data

US 2006/0170373 A1 Aug. 3, 2006

(30) Foreign Application Priority Data

Feb. 2, 2005 (KR) ..... 10-2005-0009654

(51) Int. Cl.
*G09G 3/32* (2006.01)
*G05F 1/00* (2006.01)

(52) U.S. Cl. ..... 345/82; 345/84; 345/83; 315/291; 315/307; 315/312

(58) Field of Classification Search ..... 345/82, 345/83, 84; 315/291, 307, 247, 246, 224, 315/225, 312, 316
See application file for complete search history.

(56) References Cited

U.S. PATENT DOCUMENTS 6,320,330 B1 * 11/2001 Haavisto et al. ..... 315/291
6,329,764 B1 12/2001 Van de Ven
6,909,249 B2 * 6/2005 Otake ..... 315/291
7,071,762 B2 * 7/2006 Xu et al. ..... 327/423
2004/0135522 A1 7/2004 Berman et al.
2004/0208011 A1 10/2004 Horiuchi et al.

FOREIGN PATENT DOCUMENTS

| | | | |
|---|---|---|---|
| EP | 1 229 764 | A3 | 8/2002 |
| JP | 10-284282 | A | 10/1998 |
| JP | 2001-308384 | A | 11/2001 |
| KR | 2003-0050990 | A | 6/2003 |
| KR | 2004-0019544 | A | 3/2004 |
| WO | WO 2004/100614 | A1 | 11/2004 |

* cited by examiner

*Primary Examiner*—Tuyet Vo
(74) *Attorney, Agent, or Firm*—Sughrue Mion, PLLC

(57) ABSTRACT

A light emitting diode (LED) driver to drive an LED, including a current adjusting unit to adjust magnitude of a current flowing on the LED by supplying power from a power supply device to the LED and cutting off the power. A modulation control unit is provided to modulate a waveform of the current flowing on the LED by controlling the adjustment operation of the current adjusting unit. A constant current offset unit to control the adjustment operation of the current adjusting unit is provided so that the current flowing on the LED is higher or equal to a predetermined value as the waveform thereof is modulated. Thus, provided is an LED driver having improved power consumption efficiency.

5 Claims, 7 Drawing Sheets

LED DRIVER WITH CONSTANT CURRENT OFFSET UNIT

CROSS-REFERENCE TO RELATED APPLICATIONS

This application claims the benefit of Korean Patent Application No. 2005-0009654, filed on Feb. 2, 2005, in the Korean Intellectual Property Office, the entire disclosure of which is incorporated herein by reference.

BACKGROUND OF INVENTION

1. Field of Invention

Apparatuses consistent with the present invention relate to a light emitting diode (LED) driver, and more particularly, to an LED driver that can improve efficiency of power consumption.

2. Description of the Related Art

An LED is used as a backlight for a liquid crystal display (LCD), where plural arrays of LEDs are provided for each of three colors, Red, Green and Blue.

A conventional driver used to drive LEDs can be configured with a circuit as illustrated in FIG. 1. In the driver 1 of FIG. 1, when a switching field effect transistor (FET) 2 is in an ON state, the current supplied by power source 5 flows on an LED 6 through an inductor 3, whereas, when the switching FET 2 is in an OFF state, the current flows on the LEDs by way of the inductor 3 and a diode 4.

The driver 1 controls the current flowing on the LED (hereinafter shortened as "LED current") to have a predetermined peak value (so called "analog dimming"), and controls the LED current to be ON or OFF, through the use of a pulse width modulation (PWM) signal, having a predetermined duty cycle (so called "PWM dimming"), thereby adjusting luminance of the light emitted by the LED 6.

The LED current controlled by the driver 1 may be shaped with approximately square waves as illustrated in FIG. 2. If the peak value of the square wave is approximate to the maximum rated current of the LED 6 and its minimum value is approximately 0, the LED current and the average luminance of the LED 6 by the LED current is as illustrated in FIG. 3, by averaging the square waves. Here, an X axis indicates LED current and a Y axis indicates LED light output.

The average luminance of the LED provided by the LED current, shaped with square waves, is represented in the form of a straight line B, connecting a starting point of X-Y coordinates to the luminance value of the LED corresponding to the maximum rated current of the LED.

However, when direct current that is approximately constant in magnitude (hereinafter referred to as "constant current": see FIG. 2) flows on the LED 6, the luminance of the LED 6 by the LED current is the same as a curve A depicted in FIG. 3. In this case, a relationship between current and luminance is not linear, but shows an exponential function wherein the light output of the LED 6 is saturated if the LED current is larger than a predetermined magnitude.

Accordingly, even in the LED current or LED average current having the same magnitude, a difference D1 occurs between the luminance (A) and the average luminance (B) of the LED 6 respectively to the constant current and the square wave current, as depicted in FIG. 3. For example, where the duty cycle of the square wave is 50%, the difference in efficiency between the luminance (A) and the average luminance (B) of the LED 6 respectively to the constant current and the square wave current is about 15% in terms of power.

As a result, like PWM control under which the LED current is shaped with square waves, controlling the LED current which is a periodical direct current is less efficient than controlling the LED current which is the constant current, in terms of power consumption.

SUMMARY OF THE INVENTION

Accordingly, it is an aspect of the present invention to provide an LED driver having improved efficiency of power consumption.

Additional aspects of the invention will be set forth in part in the description which follows.

In an exemplary embodiment, aspects of the present invention are achieved by providing a light emitting diode (LED) driver to drive an LED, comprising a current adjusting unit to adjust magnitude of a current flowing on the LED by supplying power from a power supply device to the LED and cutting off the power; a modulation control unit to modulate a waveform of the current flowing on the LED by controlling the adjustment operation of the current adjusting unit; and a constant current offset unit to control the adjustment operation of the current adjusting unit so that the current flowing on the LED is higher or equal to a predetermined value as the waveform thereof is modulated.

According to an aspect of the present invention, the current adjusting unit comprises a switching unit to input an ON or OFF signal to thereby supply power to the LED from a power supply device and cut off the power; a regulating unit to regulate the current flowing on the LED so that it is not abruptly changed; a current detecting unit to detect the current flowing on the LED; and a switching control unit to output a signal to turn off the switching unit when the current detected by the current detecting unit is determined to be higher than or equal to a first threshold, but to output a signal to turn on the switching unit when the current detected by the current detecting unit is determined to be less than the first threshold.

According to an aspect of the present invention, the modulation control unit inputs a predetermined pulse width modulation (PWM) signal to thereby supply an output signal of the switching control unit to the switching unit and to cut off the output signal.

According to an aspect of the present invention, the constant current offset unit outputs a signal to turn off the switching unit when the current flowing on the LED detected by the current detecting unit is determined to be higher than or equal to a second threshold and the output signal from the switching control unit is cut off, but outputs a signal to turn on the switching unit when the current flowing on the LED is determined to be less than the second threshold.

According to an aspect of the present invention, the constant current offset unit comprises a comparator to compare a voltage corresponding to the current flowing on the LED, which is detected by the current detecting unit, with a voltage corresponding to the second threshold, and output a logic HIGH signal when the voltage corresponding to the current flowing on the LED is higher; a set-reset (S-R) flip flop to set an output signal from the comparator as a RESET input and a pulse signal having a predetermined frequency as a SET input; and an OR gate to receive an output signal from the S-R flip flop and an output signal from the modulation control unit, outputting the logical sum of the received output signals to the switching unit.

BRIEF DESCRIPTION OF THE DRAWINGS

The above and/or other aspects of the present invention will become apparent and more readily appreciated from the following description of the exemplary embodiments, taken in conjunction with the accompany drawings of which.

DETAILED DESCRIPTION OF EXEMPLARY EMBODIMENTS OF THE INVENTION

Figure 1:
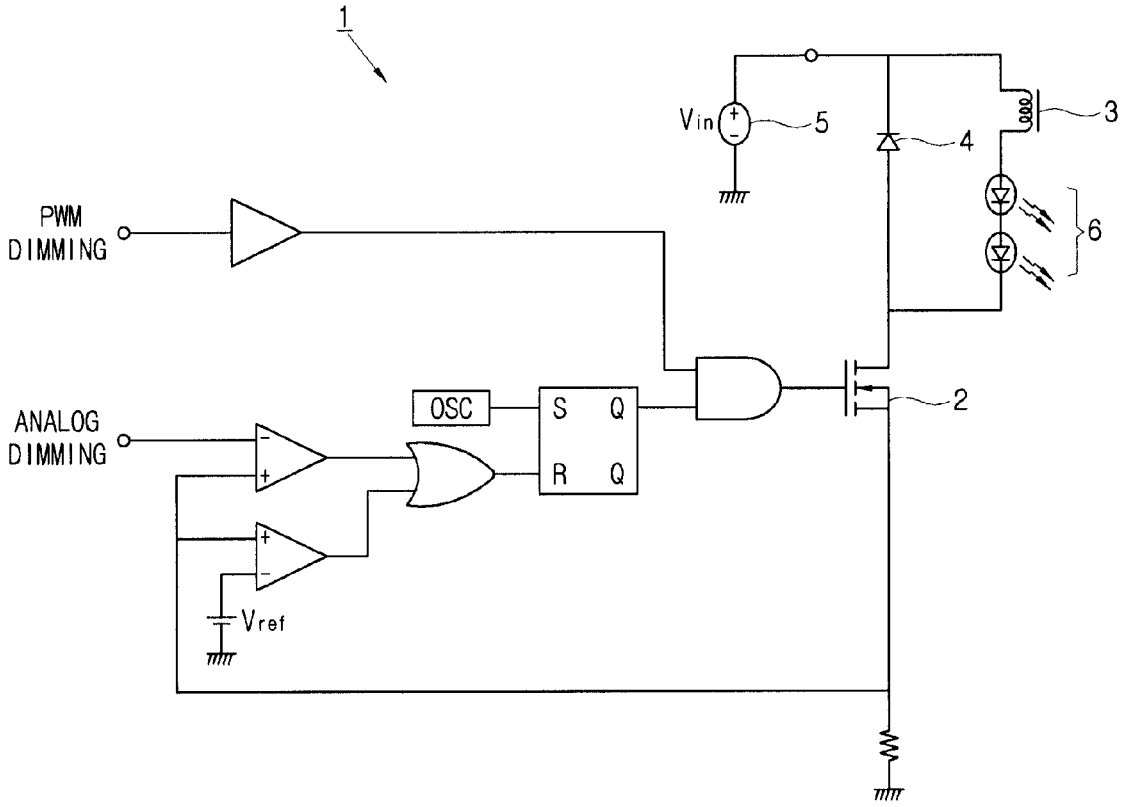
FIG. 1 (PRIOR ART)
FIG. 1 is a circuit diagram illustrating a circuit configuration of a conventional LED driver.
Figure 2:
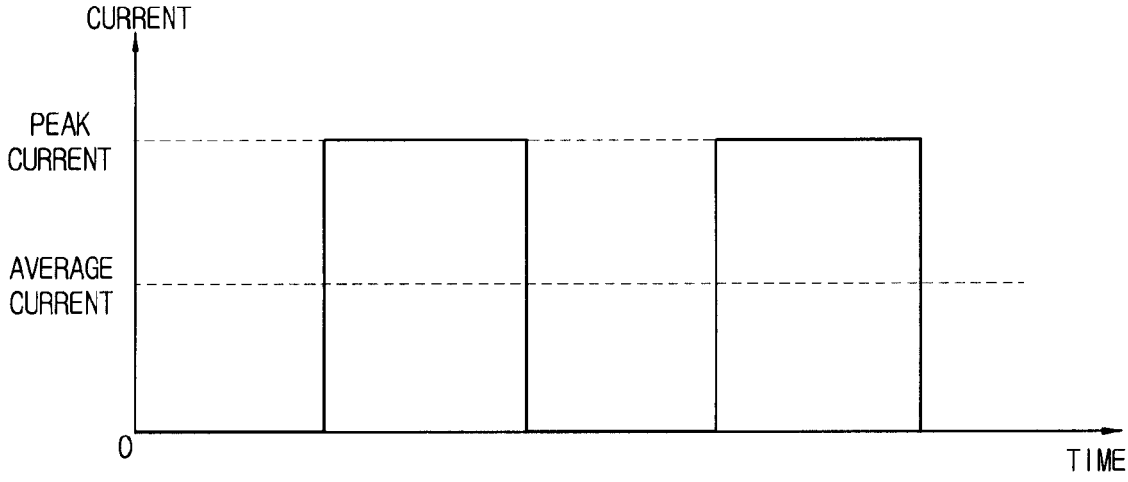
FIG. 2 (PRIOR ART)
FIG. 2 is a waveform diagram schematically illustrating a waveform of a current flowing on an LED driven by the LED driver of FIG. 1.
Figure 3:
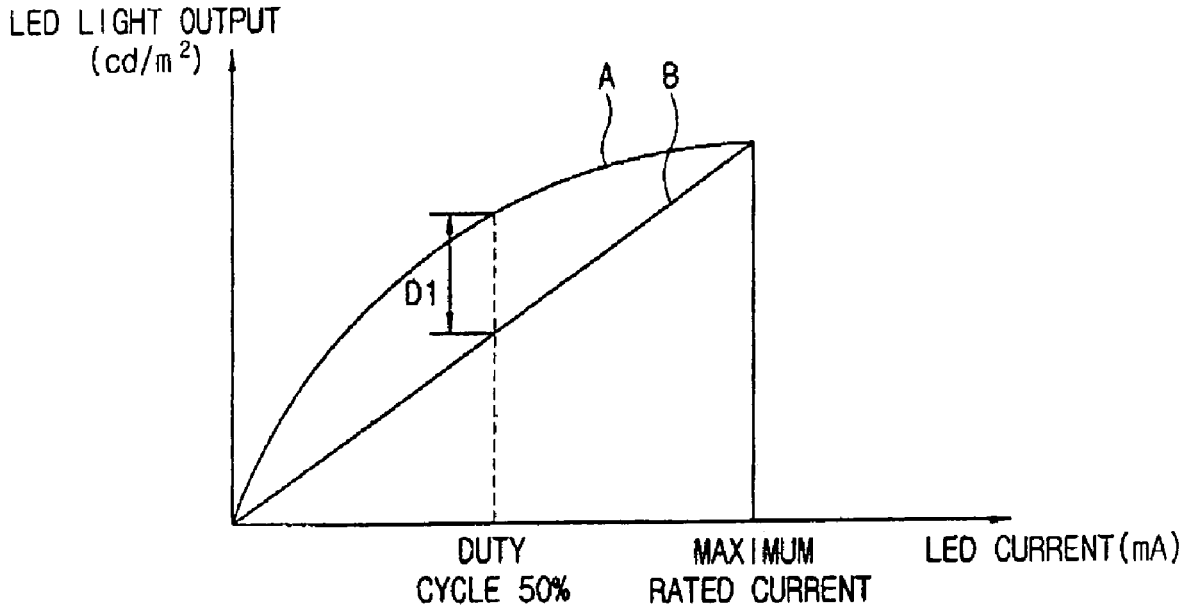
FIG. 3 illustrates a comparison of an LED current with a predetermined constant current in terms of an LED light output.
Figure 4:
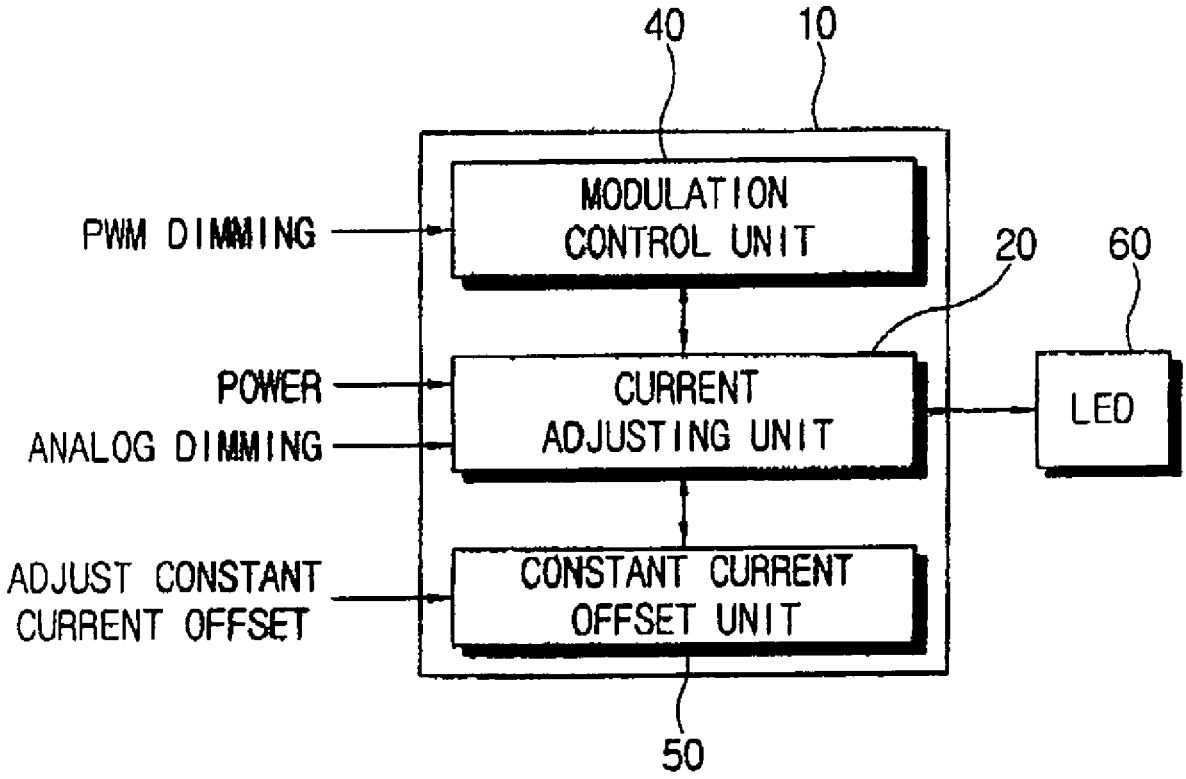
FIG. 4 is a block diagram schematically illustrating a configuration of an LED driver according to an exemplary embodiment of the present invention.

Reference will now be made in detail to the exemplary embodiments of the present invention, examples of which are illustrated in the accompanying drawings, wherein like reference numerals refer to like elements throughout. The exemplary embodiments are described below in order to explain the present invention by referring to the figures. FIG. 4 is a block diagram illustrating an internal configuration of an LED driver 10 according to an exemplary embodiment of the present invention.

The LED driver 10 drives an LED 60 which may be used as a backlight for a liquid crystal display and so on. The LED driver 10 adjusts the luminance of the light emitted by the LED 60, by controlling current flowing on the LED 60 supplied with power from a source.

The LED driver 10 controls the luminance of the LED 60, by adjusting a peak value of an LED current and modulating a waveform of the LED current, and also supplies an offset current so as to allow the LED current to maintain at least a predetermined constant level.

The LED driver 10, as illustrated in FIG. 4, comprises a current adjusting unit 20, a modulation control unit 40 and a constant current offset unit 50.

The current adjusting unit 20 adjusts a magnitude of the current flowing on the LED 60 through so-called analog dimming. A circuit configuration of the current adjusting unit 20 according to this exemplary embodiment is illustrated in FIG. 5.

Figure 5:
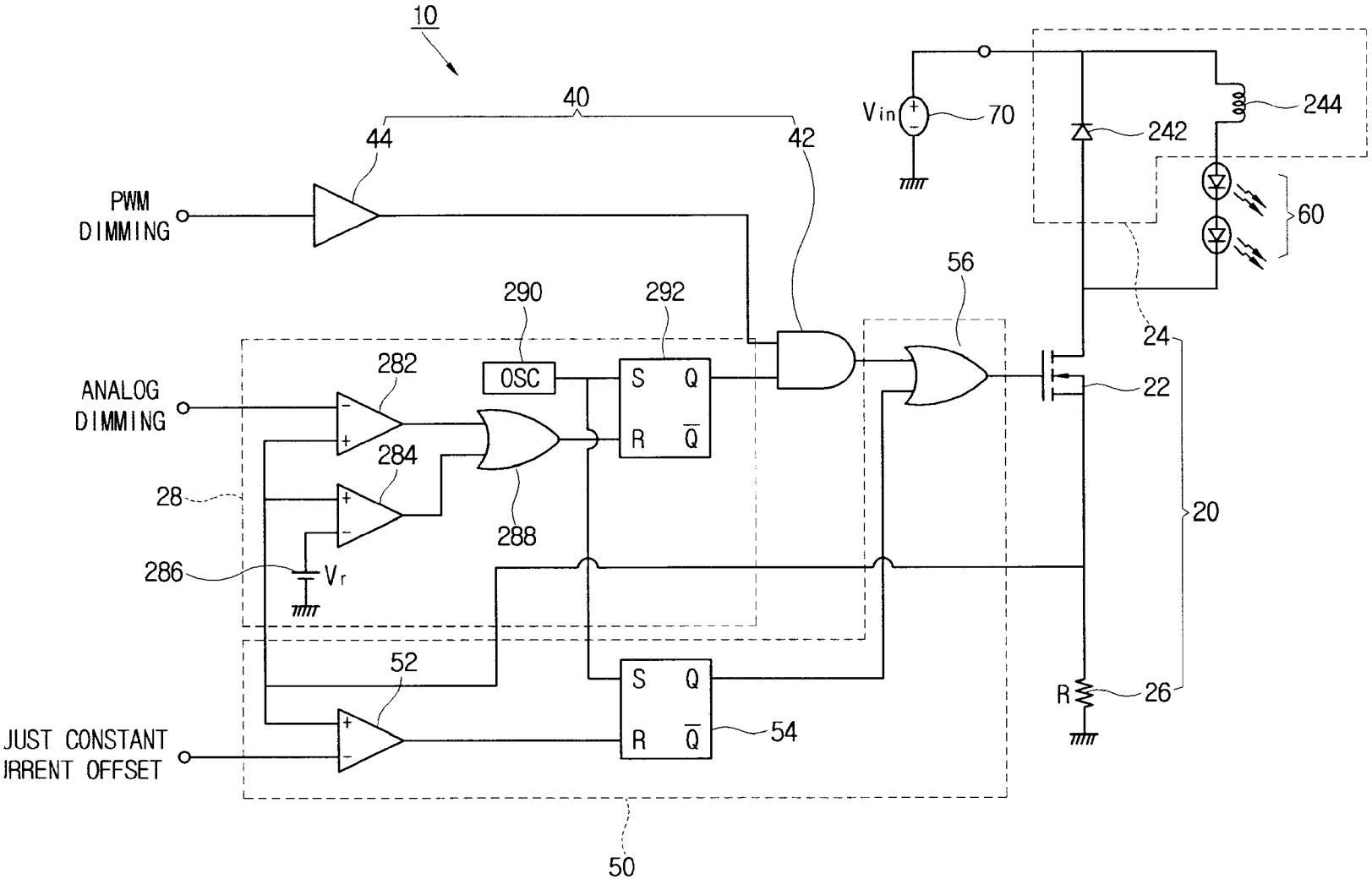
FIG. 5 is a circuit diagram illustrating an exemplary circuit configuration of the LED driver of FIG. 4.

Referring to FIG. 5, the current adjusting unit 20 comprises a switching unit 22, a regulating unit 24, a current detecting unit 26 and a switching control unit 28.

The switching unit 22 inputs an ON or OFF signal, thereby supplying or not supplying the LED 60 with power from a power supply unit 70, according to either the ON or OFF signal inputted. The switching unit 22 is embodied with a metal oxide semiconductor field-effect transistor (MOSFET). Into a gate of the MOSFET of the switching unit 22 is inputted an output signal from the switching control unit 28.

The regulating unit 24 regulates the current flowing on the LED 60 so as not to be abruptly changed. In this exemplary embodiment, the regulating unit 24 is embodied with a diode 242 and an inductor 244. The diode 242 and the inductor 244 are connected to the power supply unit 70 in parallel, and the inductor 244 is connected to the LED 60 in series.

An anode of the diode 242 is connected to a drain of the MOSFET in the switching unit 22, and a cathode thereof is connected to the power supply unit 70. The switching unit 22 inputs an ON signal whereby the drain and a source of the MOSFET in the switching unit 22 are electrically connected, and the current flows on the LED 60 by a voltage Vin of the power supply unit 70 through the inductor 244. In this case, the inductor is charged with current energy, and the LED current increases by a predetermined value.

If electrical connection between the drain and the source of the MOSFET in the switching unit 22 is broken the switching unit 22 inputs an OFF signal. The inductor 244, the LED 60 and the diode 242 constitutes a closed circuit. Accordingly, the current flows on the LED 60 by the energy stored in the inductor 244. In this case, the LED current is reduced as the current energy of the inductor 244 is discharged.

The current detecting unit 26 detects the current flowing on the LED 60. The current detecting unit 26 is embodied with a resistor having a resistance value of R. At this time, since the current flowing on the resister is of the same as the current flowing on the LED 60, the LED current is estimated by use of the voltage applied to an input terminal of the resister.

When the current detecting unit 26 determines that the current detected thereby is larger than or equal to a predetermined first threshold, the switching control unit 28 turns off the switching unit 22. When the current detected by the current detecting unit 26 is determined to be less than the first threshold, the switching control unit 28 turns on the switching unit 22.

That is, the switching control unit 28 evaluates the magnitude of the current flowing on the LED 60, and adjusts the magnitude of the LED current, by comparing it with the first threshold capable of being preset or adjusted and outputting a signal to turn on or off the switching unit 22 so that the LED current can maintain the current value around the first threshold.

The switching control unit 28 in this exemplary embodiment comprises two comparators 282 and 284, an OR gate 288, an oscillator 290 and an S-R flip flop 292. The two comparators 282 and 284 may be embodied with operational amplifiers (OP-amp), and a voltage across the resistor of the current detecting unit 26 is applied to each non-inverting input terminal thereof.

A reference voltage Vr is applied to an inverting input terminal of the comparator 284. When the voltage across the resistor of the current detecting unit 26, i.e., the voltage corresponding to the LED current, is higher than the reference voltage Vr, the comparator 284 outputs a logic HIGH signal. It is preferred that the reference voltage Vr is determined with the consideration of the maximum rated current and the resistance value R of the LED 60.

A predetermined voltage from outside is applied to the inverting input terminal of the comparator 282. When the voltage across the resistor of the current detecting unit 26, that is, the voltage corresponding to the LED current is higher than a predetermined input voltage, the comparator 284 outputs a logic HIGH signal. In this case, the voltage externally applied is less than the voltage corresponding to the maximum rated current, but it corresponds to the current determined not to exceed the LED current.

The logical sum of output signals from the two comparators 282 and 284 is applied to a RESET input of the S-R flip flop 292 through an OR gate. An output signal of the oscillator 290 is applied to a SET input of the S-R flip flop 292. The oscillator 290 outputs a pulse signal of a predetermined frequency.

Where the output signal of the oscillator 290 is a logic HIGH signal, the S-R flip flop 292 outputs a corresponding logic HIGH signal, and maintains it. In an exemplary embodiment, whenever the output signal of the OR gate 288 is a logic HIGH signal, the S-R flip flop 292 outputs a logic LOW signal. That is, the S-R flip flop 292 outputs a logic LOW signal when the voltage corresponding to the LED current is higher than the reference voltage Vr or the voltage externally adjusted, but it outputs logic HIGH signals in the other cases. Therefore, the switching control unit 28 adjusts the magnitude of the LED current by outputting a signal to turn on or off, so that the LED current can maintain a predetermined peak value within the limitation that it does not exceed the maximum rated current.

The modulation control unit 40 modulates a waveform of the LED current by controlling an operation of the current adjusting unit 20, thereby adjusting the luminance of the light outputted by the LED current. The modulation control unit 40 according to this exemplary embodiment inputs a pulse width modulation (PWM) signal, and supplies or does not supply an output signal of the switching control unit 28 to the switching unit 22 according to the signal inputted.

The modulation control unit 40 of this exemplary embodiment is embodied with a buffer 44 and an AND gate 42. The AND gate 42 has two input terminals: a PWM signal is applied to one input terminal through the buffer 44 from the outside, and an output signal of the switching control unit 28 is applied to the other input terminal. The AND gate 42 outputs a signal for logical multiplication of the two input signals.

The PWM signal inputted by the AND gate 42 is a pulse signal having predetermined period and duration. In an exemplary embodiment, when the PWM signal is logically HIGH, the output signal of the switching control unit 28 becomes identical to the output signal of the AND gate 42.

When the PWM signal is logically LOW, the output signal of the AND gate 42 becomes logically LOW. Accordingly, the output signal of the switching control unit 28 is not transmitted to the switching unit 22 although it is logically HIGH, whereby the switching unit 22 is not turned on.

Considering this, the magnitude of the average current flowing on the LED 60 may be adjusted by properly adjusting the pulse width or the duty cycle of the PWM signal. In other words, the average current flowing on the LED 60 increases if the pulse width or duty cycle of the PWM signal increases, whereas the average current flowing on the LED 60 decreases if the pulse width or duty cycle of the PWM signal is reduced. In this case, the peak current is more promptly adjusted in comparison with the pulse width control, by setting up a period of the PWM signal sufficiently longer than that of the oscillator 290.

The constant current offset unit 50 provides control so that the current flowing on the LED 60 maintains its predetermined size. That is, the constant current offset unit 50 provides control so that a predetermined size of constant current additionally flows on the LED 60 on which the current shaped with approximately square waves becomes flowing by the pulse width control.

The constant current offset unit 50 of this exemplary embodiment outputs a signal to turn off the switching unit 22 when the current detecting unit 26 determines the LED current detected thereby to be higher than or equal to the predetermined second threshold, and the output signal of the switching control unit 28 to be broken. But the constant current offset unit 50 outputs a signal to turn on the switching unit 22 when the LED current is determined to be less than the second threshold value.

In other words, when the current flowing on the LED 60 is less than the reference value established externally, the constant current offset unit 50 outputs a signal to turn on the switching unit 22, thereby allowing the current having at least the reference value to flow on the LED 60.

The constant current offset unit 50 of this exemplary embodiment comprises a comparator 52, an S-R flip flop 54 and an OR gate 56. The comparator 52 can be embodied with an OP-amp by way of example. To an inverting input terminal of the comparator 52 is applied a voltage corresponding to the magnitude of current to be offset as a voltage that can be set up externally, and a voltage across both terminals of the current detecting unit 26 is applied to a non-inverting input terminal thereof. The comparator 52 outputs a logical HIGH signal when the voltages across both terminals of the current detecting unit 26, that is, the voltage corresponding to the LED current, is higher than the voltage corresponding to the current value externally established.

An output signal from the oscillator 290 is applied to a SET input terminal of the S-R flip flop 54, and an output signal from the comparator 52 is applied to a RESET input terminal thereof. The operation of the S-R flip flop 54 is similar to that of the S-R flip flop 292. When the LED current is higher than the current value externally established, the S-R flip flop 54 outputs a logical LOW signal, but it outputs a logical HIGH signal in the other cases.

The OR gate 56 receives output signals from the modulation control unit 40 and the S-R flip flop 54 respectively, thereby outputting a logical OR signal thereof to a gate input terminal of the switching unit 22. That is, the OR gate 56 outputs a logical HIGH signal to turn on the switching unit 22 when the LED current is less than the externally established current value, while it outputs a logical LOW signal to turn off the switching unit 22 when the LED current is higher than the externally established current value and the PWM signal is logically LOW.

Figure 6:
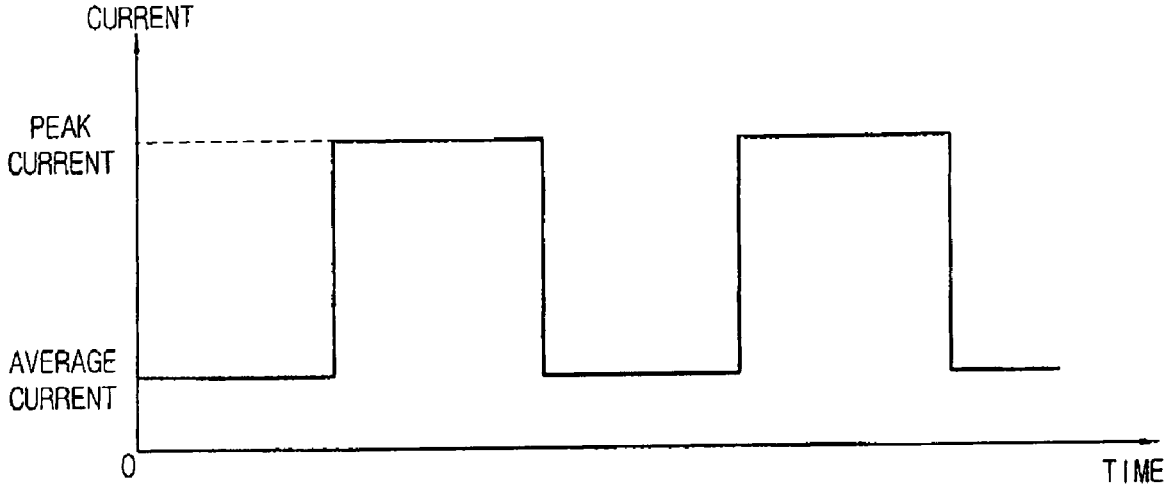
FIG. 6 is a waveform diagram schematically illustrating a waveform of a current flowing on an LED driven by the LED driver of FIG. 5.

A waveform of the current flowing on the LED 60 by the LED driver 10 according to this exemplary embodiment as described above is illustrated in FIG. 6. Referring to FIG. 6, the LED current demonstrates a waveform created by combining the square wave with an offset current of a predetermined constant level.

Figure 7:
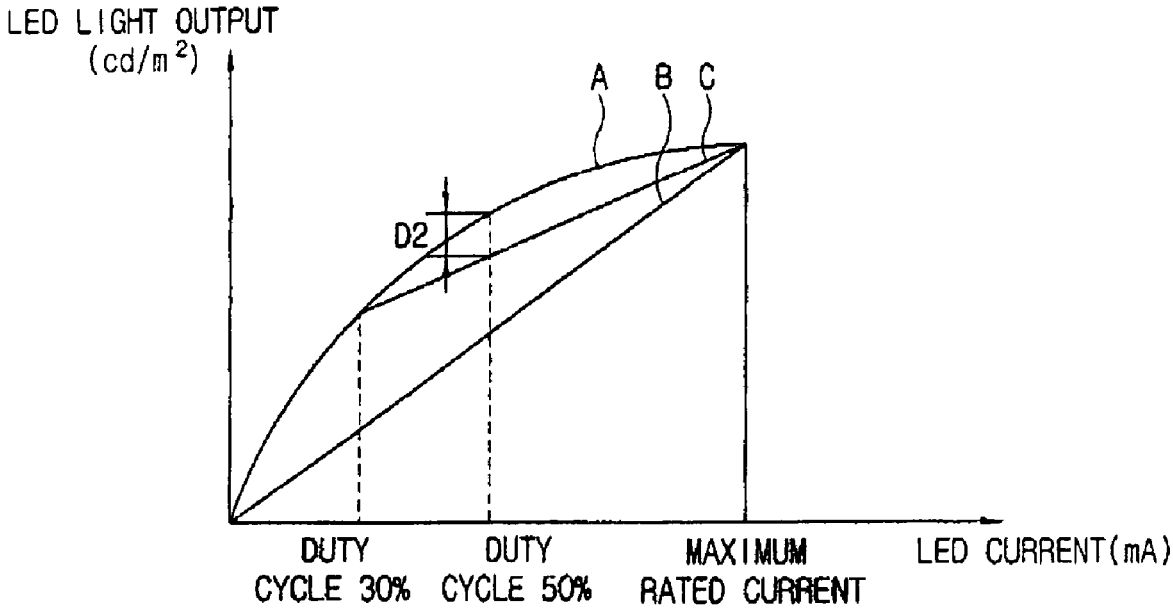
FIG. 7 illustrates a comparison of an LED current with a predetermined constant current in terms of an LED light output of FIG. 6.

The luminance of the light output of the LED 60 due to the current flowing on the LED 60 by the LED driver 10 according to this exemplary embodiment is illustrated in FIG. 7. Referring to FIG. 7, the luminance of the light output of the LED 60 is indicated in the form of a straight line C when the magnitude of the offset current is 30% of the maximum rated current. When the duty cycle of the PWM signal is 50%, a difference (D2) from the luminance A due to the constant current identical in magnitude to the average current thereof becomes approximately 5% in view of the power efficiency. According to the LED driver 10 of this exemplary embodiment, the power efficiency may be enhanced by about 10%, but the loss of power may be 15% when there is no offset current.

As described above, the present invention can provide an LED driver having improved efficiency in power consumption. Although a few exemplary embodiments of the present invention have been shown and described, it will be appreciated by those skilled in the art that changes may be made in these embodiments without departing from the principles and spirit of the invention, the scope of which is defined in the appended claims and their equivalents. For example, the modulation control unit can be variously worked so that the LED current becomes a periodical direct current shaped with a sine wave, a triangular wave as well as a square wave.

What is claimed is:

1. A light emitting diode (LED) driver to drive an LED, comprising:

a current adjusting unit which performs an adjustment operation to adjust magnitude of a current flowing on the LED by supplying power from a power supply device to the LED and cutting off the power;

a modulation control unit to modulate a waveform of the current flowing on the LED by controlling the adjustment operation of the current adjusting unit; and a constant current offset unit to control the adjustment operation of the current adjusting unit so that the current flowing on the LED is higher or equal to a predetermined value as the waveform thereof is modulated.

2. The LED driver according to claim 1, wherein the current adjusting unit comprises:

a switching unit to input an ON or OFF signal to thereby supply the power to the LED from the power supply device and cut off the power;

a regulating unit to regulate the current flowing on the LED so that it is not abruptly changed;

a current detecting unit to detect the current flowing on the LED; and a switching control unit to output a signal to turn off the switching unit when the current detected by the current detecting unit is determined to be higher than or equal to a first threshold, and the switching control unit to output a signal to turn on the switching unit when the current detected by the current detecting unit is determined to be less than the first threshold.

3. The LED driver according to claim 2, wherein the modulation control unit inputs a predetermined pulse width modulation (PWM) signal to supply an output signal of the switching control unit to the switching unit and to cut off the output signal.

4. The LED driver according to claim 3, wherein the constant current offset unit outputs a signal to turn off the switching unit when the current flowing on the LED detected by the current detecting unit is determined to be higher than or equal to a second threshold and the output signal from the switching control unit is cut off, and the constant current offset unit outputs a signal to turn on the switching unit when the current flowing on the LED is determined to be less than the second threshold.

5. The LED driver according to claim 4, wherein the constant current offset unit comprises:

a comparator to compare a voltage corresponding to the current flowing on the LED, which is detected by the current detecting unit, with a voltage corresponding to the second threshold, and to output a logic HIGH signal when the voltage corresponding to the current flowing on the LED is higher;

a set-reset (S-R) flip flop to set an output signal from the comparator as a RESET input and a pulse signal having a predetermined frequency as a SET input; and an OR gate to receive an output signal from the S-R flip flop and an output signal from the modulation control unit, outputting the logical sum of the received output signals to the switching unit.

* * * * *